US011808508B2

(12) United States Patent
Olson, Jr. et al.

(10) Patent No.: US 11,808,508 B2
(45) Date of Patent: Nov. 7, 2023

(54) ICE-MAKING DEVICE FOR SQUARE CUBES USING PAN PARTITION AND PIN SERPENTINE EVAPORATORS

(71) Applicant: PENTAIR FLOW SERVICES AG, Schaffhausen (CH)

(72) Inventors: William E. Olson, Jr., Bellevue, WI (US); Richard T. Miller, Manitowoc, WI (US); Timothy L. Hynek, Manitowoc, WI (US); John P. Myers, Manitowoc, WI (US)

(73) Assignee: PENTAIR FLOW SERVICES AG, Schaffhausen (CH)

( * ) Notice: Subject to any disclaimer, the term of this patent is extended or adjusted under 35 U.S.C. 154(b) by 203 days.

(21) Appl. No.: 17/173,260

(22) Filed: Feb. 11, 2021

(65) Prior Publication Data

US 2021/0247121 A1 Aug. 12, 2021

Related U.S. Application Data

(60) Provisional application No. 62/975,444, filed on Feb. 12, 2020.

(51) Int. Cl.
*F25C 5/10* (2006.01)
*F25C 1/12* (2006.01)

(52) U.S. Cl.
CPC ..... *F25C 5/10* (2013.01); *F25C 1/12* (2013.01); *F25C 2600/02* (2013.01); *F25C 2600/04* (2013.01); *F25C 2700/04* (2013.01); *F25C 2700/12* (2013.01)

(58) Field of Classification Search
CPC ..... F25C 27/004; F25C 5/10; F25C 2700/12; F25C 1/04; F25C 1/246; F25C 1/08; F25C 2400/10; F25C 1/12; F25C 1/045; F25C 2700/152; F25C 2700/04; F25C 2600/04
See application file for complete search history.

(56) References Cited

U.S. PATENT DOCUMENTS

| | | | | |
|---|---|---|---|---|
| 2,949,019 | A | 8/1960 | Roberts | |
| 3,380,261 | A | 4/1968 | Hendrix et al. | |
| 4,774,815 | A * | 10/1988 | Schlosser | F25B 41/20 62/352 |
| 5,182,925 | A | 2/1993 | Alvarez et al. | |
| 2002/0043073 | A1 | 4/2002 | Park et al. | |
| 2009/0120122 | A1* | 5/2009 | Gradl | F25D 23/126 62/389 |
| 2017/0003062 | A1 | 1/2017 | Olson, Jr. | |
| 2018/0017304 | A1* | 1/2018 | Knatt | F25C 1/045 |
| 2020/0400363 | A1* | 12/2020 | Junge | F25C 5/10 |

OTHER PUBLICATIONS

International Search Report dated Apr. 28, 2021 for PCT Appl. No. PCT/US2021/017521.
Written Opinion dated Apr. 28, 2021 for PCT Appl. No. PCT/US2021/017521.
International Preliminary Report on Patentability (IPRP) dated Dec. 24, 2021 for PCT Appl. No. PCT/US2021/017521.

* cited by examiner

*Primary Examiner* — Cassey D Bauer
(74) *Attorney, Agent, or Firm* — Husch Blackwell LLP

(57) ABSTRACT

The present disclosure provides an ice making evaporator that combines the cubic shape of pan and partition evaporators with the central ice making of a pin evaporator to achieve an ice shape that is mostly cubic. Separation of the cooling ability of these two evaporator portions allows cube shaping during ice making cycle based on time, temperature, pressure, or other variables.

22 Claims, 6 Drawing Sheets

Fig. 1a
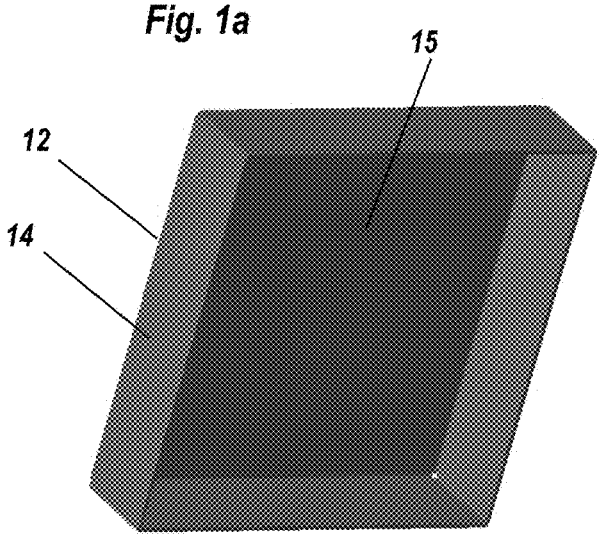
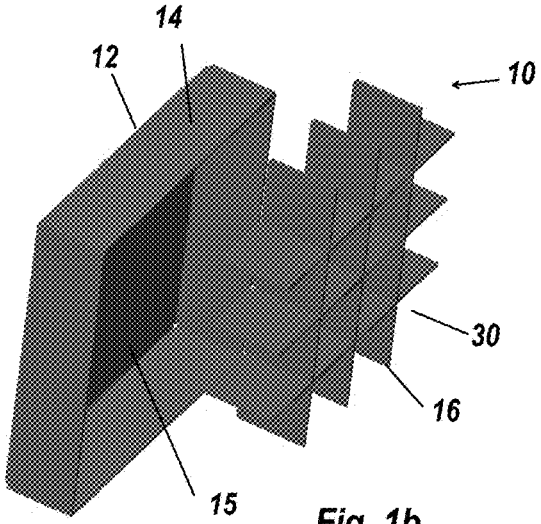
Fig. 1b
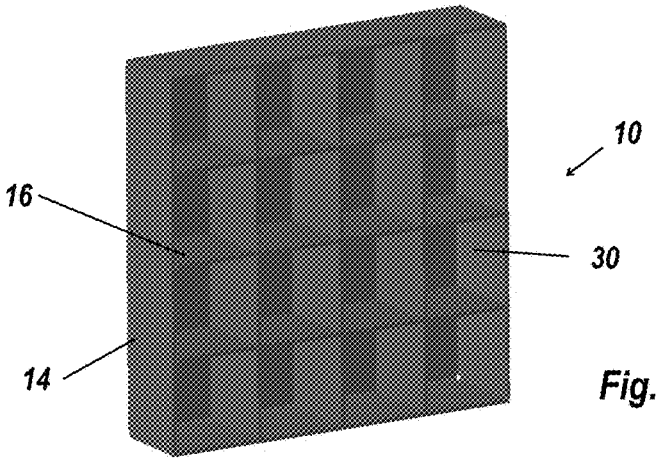
Fig. 1c

| | |
|---|---|
| 101 | Compressor |
| 102 | Condenser |
| 103 | Receiver (optional) |
| 104 | Filter Drier |
| 105 | Liquid Line Solenoid - Pan |
| 106 | Liquid Line Solenoid - Pins (optional) |
| 107 | Expansion Valve - Pan |
| 108 | Expansion Valve - Pins |
| 109 | Evaporator |
| 110 | Harvest Strainer / Manifold |
| 111 | Harvest Valve - Pins |
| 112 | Harvest Valve - Pan |

| | |
|---|---|
| 201 | Water Pump |
| 202 | Water Sump |
| 203 | High Water Level Float |
| 204 | Low Water Level Float |
| 205 | Water Inlet Valve |
| 1 | Evaporator |
| 207 | Water Curtain |
| 208 | Evaporator Thermistor |

ICE-MAKING DEVICE FOR SQUARE CUBES USING PAN PARTITION AND PIN SERPENTINE EVAPORATORS

CROSS-REFERENCE TO RELATED APPLICATION

The present application claims the benefit of U.S. Provisional Patent Application Ser. No. 62/975,444, filed on Feb. 12, 2020, which is herein incorporated by reference.

BACKGROUND OF THE DISCLOSURE

1. Field of the Disclosure

The present disclosure provides an ice-making machine comprising an evaporator, and a method for operating the machine. More particularly, the present disclosure provides an ice-making machine that uses both pan and partition evaporators, as well as pin evaporators. The method comprises independently controlling the evaporators, so that they can be running together, or individually one at a time.

2. Background of the Disclosure

The shape of ice particles (e.g., cubes) is largely consumer driven, and can depend greatly on the visual appeal to the customer. Currently available evaporators produce ice that has at least one aspect that is undesirable to a consumer. The current evaporators may produce ice that doesn't form evenly, leading for example to ice cubes that have an empty center or "dimple" in the middle of the cube. Other evaporators that try to form the ice cube more evenly produce ice particles or cubes that are not visually appealing to the consumer.

Accordingly, there is a need for an ice-making machine and evaporator that forms ice particles efficiently and in such a way that the resulting particle is visually appealing to a consumer.

SUMMARY OF THE DISCLOSURE

The ice making machine of the present disclosure comprises an evaporator having both a pan- or box-shaped evaporator as well as a pin-shaped evaporator. The pan-shaped evaporator has bent up edges or side walls that define a center portion, and there are a plurality of partitions in the center portion that form at least one cell. The pins of the pin-shaped evaporator project into the cell(s). Water is sprayed on or otherwise applied to the cell, where it is frozen. This provides a generally cube-shaped ice particle that has the cube appearance that many consumers prefer. The pan-shaped evaporator cools the water and the forming cube from the exterior sides inward. The pin-shaped evaporator cools the water and the forming cube from the inside out, ensuring a quicker and more efficient cooling, while also preventing the dimples or divots on the ice particles that many currently available evaporators provide.

The two evaporators of the present disclosure can be independently operated. They may both be in operation at the same time, or one may be in operation while the other is shut off. The method of the present disclosure comprises controlling the evaporators in this way.

Accordingly, in one embodiment the present disclosure provides an ice-making machine comprising a compressor, a refrigerant, a first evaporator, and a second evaporator connected to the first evaporator. A first fluid line is connected to the compressor at one end and the first evaporator at a second end, for carrying a first portion of the refrigerant to the first evaporator. A second fluid line is connected to the compressor at one end and the second evaporator at a second end, for carrying a second portion of the refrigerant to the second evaporator. A solenoid valve is connected to the first fluid line, for selectively opening and closing the first fluid line to the flow of refrigerant therethrough.

The present disclosure also provides a method of making ice with the ice-making machine, comprising the steps of:

- initiating a first portion of a freeze cycle;
- during the first portion of the freeze cycle, controlling the first liquid line solenoid to be open, and controlling the refrigerant to flow into each of the first evaporator and the second evaporator;
- initiating a second portion of a freeze cycle;
- during the second portion of the freeze cycle, controlling the first liquid line solenoid to close, preventing the refrigerant from flowing into the first evaporator, and continuing to control the refrigerant to flow into the second evaporator;
- initiating a harvest cycle; and
- during the harvest cycle, controlling each of a pair of harvest solenoids to open, allowing warm refrigerant to flow to each of the first evaporator and the second evaporator.

DESCRIPTION OF THE FIGURES

FIG. 1*a* shows a bottom, perspective view of a pan evaporator of the present disclosure. FIG. 1*b* shows an exploded perspective view of the pan of FIG. 1*a* with a grid insert. FIG. 1*c* shows a perspective view of the pan of FIG. 1*a* with the insert of FIG. 1*b* therein.

DETAILED DESCRIPTION OF THE DISCLOSURE

Figure 1D:
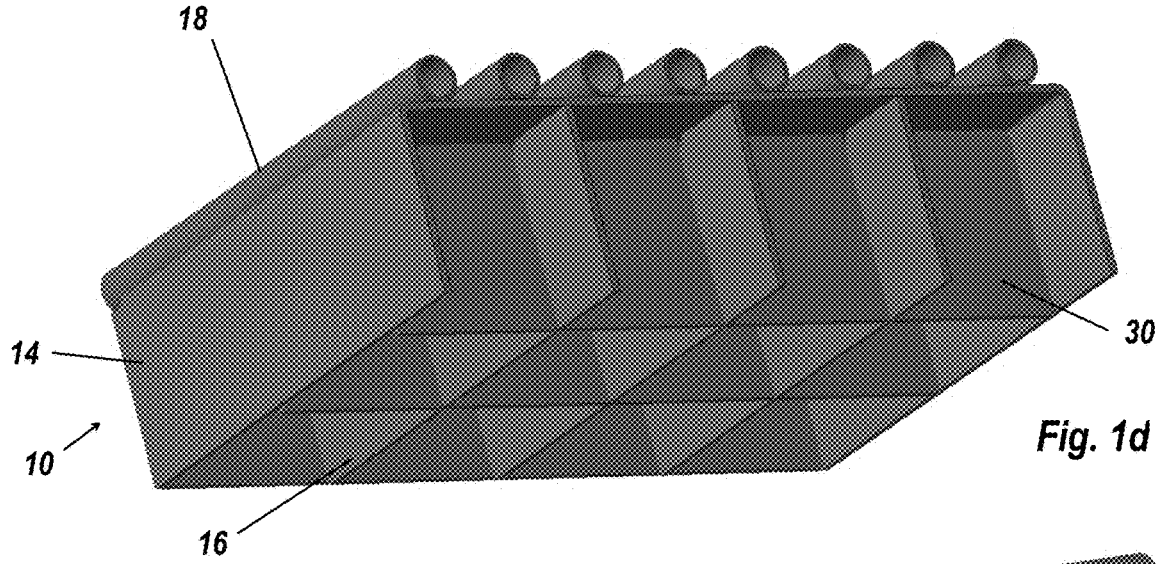
FIG. 1*d* shows the assembled pan evaporator of the present disclosure, with refrigerant coils attached to the rear of the pan.
Figure 2:
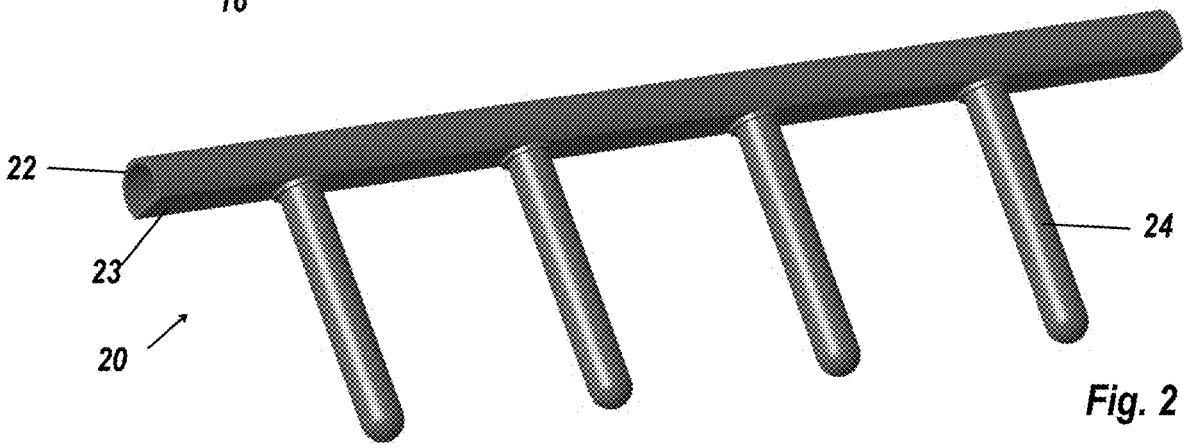
FIG. 2 shows a perspective view of the pin-shaped evaporator of the present disclosure.
Figure 3A:
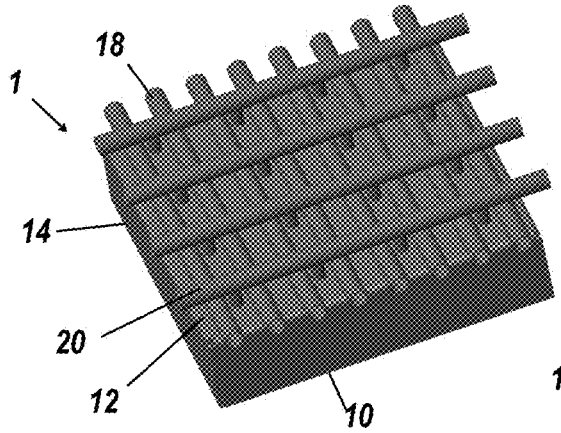
FIG. 3*a* shows a rear perspective view of an evaporator of the present disclosure, combining the pan and pin evaporators.
Figure 3B:
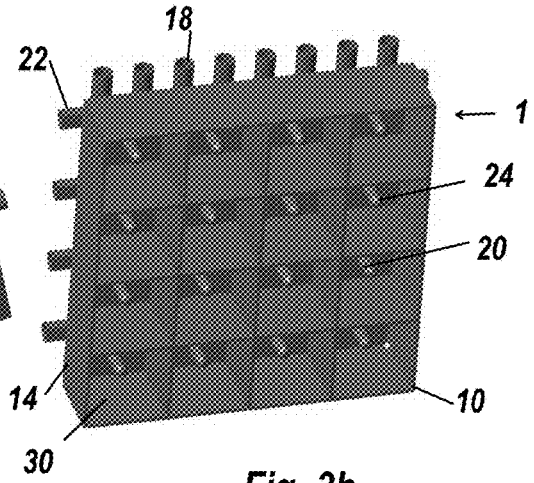
FIG. 3*b* shows a front, perspective view of the evaporator of FIG. 3*a*.
Figure 3C:
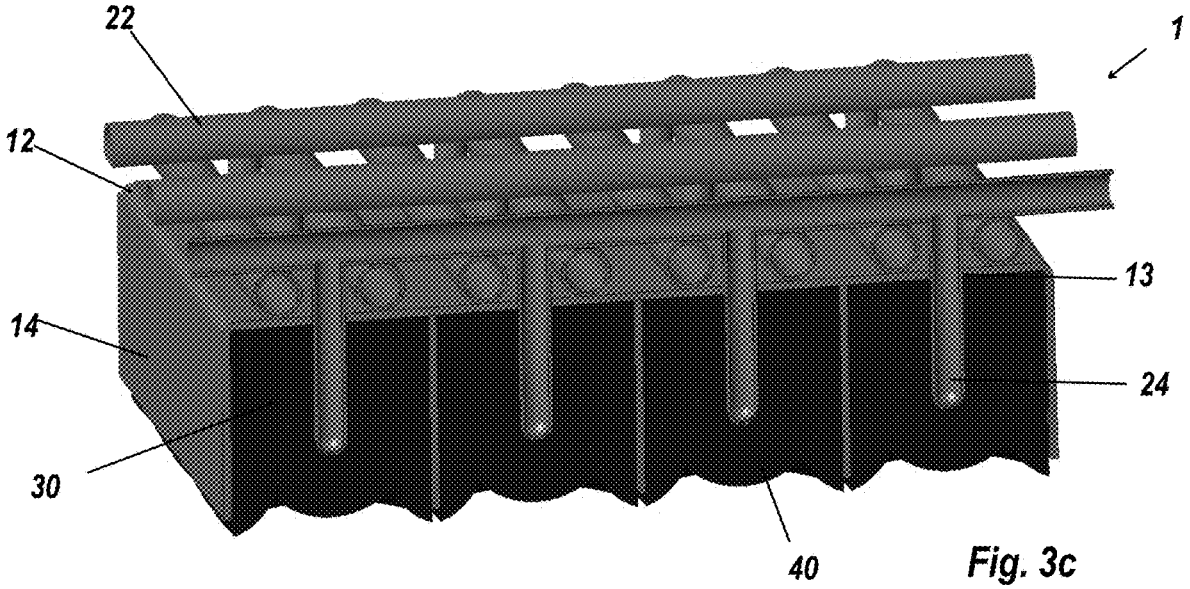
FIG. 3*c* is a cross-sectional view of the evaporator of FIGS. 3*a* and 3*b* with ice in the cells thereof.

Referring to the Figures, and in particular FIGS. 1*a*-3*c*, evaporator 1 of the present disclosure is shown. Evaporator 1 includes pan evaporator 10 and pin evaporator 20, which are connected to one another. Water is sprayed, applied, or introduced into cells 30, and can be cooled by one or both of pan evaporator 10 and pin evaporator 20. Pan evaporator 10 cools the water in cells 30 from the sides of the cell. Pin evaporator 20 projects into each of cells 30, so that it can cool the water in cells 30 from an inward portion of cell 30 outward (FIG. 3*c*). After a cooling cycle, ice particles 40 are formed.

In this way, evaporator 1 can provide several advantages not found in prior art ice-making machines. The ice particles 40 produced by evaporator 1 can have a generally cubic shape, which is commonly preferred by customers. Unlike currently available cubic-shaped ice, however, the particles 40 produced by evaporator 1 are frozen through to or at a center portion, except in the area where pin evaporator 20 projects into cell 30. There are no significant dimples or crevices in ice particle 40.

Referring specifically to FIGS. 1*a*-1*d*, pan evaporator 10 can have a plate 12 with bent up sides 14, to form a center 15 that has a depth. The depth of center 15 can approximately correspond to the desired height of ice particle 40. The size of the ice particle 40 depends on the needs of its application or use. In one embodiment, the size of ice particle 40 is two inches or less to a side.

A plurality of grid elements 16 are connected to one another, and placed into center 15, forming a plurality of cells 30. A plurality of refrigerant coils 18 are connected to plate 12 on an opposite of plate 12 from cells 30 (FIG. 1*d*). In the manner described below, a refrigerant passes through coils 18 to cool water in cells 30. Sides 14 can either be bent up portions of plate 12, i.e. unitary, as shown, or they can be separately formed and attached side walls.

Referring to FIG. 2, pin evaporator 20 is shown. Pin evaporator 20 has a manifold 22 and a plurality of protrusions or pins 24, each of which are hollow, to allow refrigerant to pass therethrough. In the manner described below, pins 24 project into cells 30, to cool water located therein. Manifold 22 may have an optional flat portion 23. This flat portion allows for easy attachment of pins 24 onto manifold 22 during fabrication of pin evaporator 20. Pins 24 are shown as round in cross-section, and these are often the easiest type of pins to make. However, the present disclosure also contemplates that pins 24 can be square, oblong, elliptical, oval, or other suitable shapes.

Referring to FIGS. 3*a*-3*c*, the assembled evaporator 1 is shown. As can be seen, pin evaporator 20 is connected to pan evaporator 10 so that pins 24 project into cells 30. Plate 12 can have a plurality of plate holes 13, one corresponding to each of cells 30, through which pins 24 pass. Holes 13 can be slightly larger in diameter than pins 24. In addition to facilitating the cooling of pin evaporator 20 in cells 30, holes 13 can allow air to pass from the back of plate 12 into cells 30. In current pan evaporators, a vacuum often forms when the water in the cells is frozen, which makes it harder to eject the ice cube. Holes 13 in evaporator 1 can make it easier to eject ice particles 40 when the cooling is done. This is another advantage of evaporator 1 over prior art devices.

Figure 4:
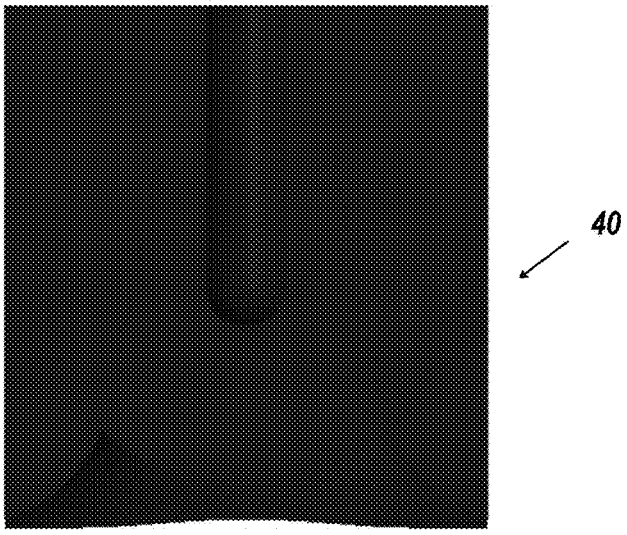
FIG. 4 shows a cross-sectional view of an ice particle that can be made with the evaporator of FIGS. 3*a* and 3*b*.

As seen in FIG. 4, ice particle 40 has a generally cubic shape, with a generally square cross-section. This is a commonly preferred shape with many consumers. Ice particle 40 is "generally" cube-shaped in that it is not necessarily perfectly flat on all sides, though it may be. It may also be flat on one, two, three, four, or five of the six sides of the cube. Unlike with prior art machines, there is no significant or deep divot in the surface of particle 40. This is due to the fact that water in cell 30 is being cooled from the center as well of the sides, due to pin evaporator 30.

One benefit of the machine of this disclosure is to provide a shorter path for pulling the heat out of the water to form ice in evaporator 1. In currently available devices, as an ice layer builds up on the surface of a pan-style evaporator, the evaporating temperature of the refrigerant inside the serpentine tubing on the back of the pan evaporator must get colder to continue pulling heat from the water through the layer of ice that has already formed. That is, once ice starts to form a layer on the surface of an evaporator, the refrigerant passing by on the other side of that surface must get colder and colder, since it is pulling heat from the unfrozen water through a layer of ice. The efficiency of the compressor in such a system goes down as the evaporating temperature of the refrigerant gets colder. With evaporator 1 of the present disclosure, by cooling each cube from the outside (via the walls of cells 30, and pan evaporator 10) and the inside (via pins 24 in pin evaporator 20), the present disclosure reduces the average thickness of ice that a refrigerant has to work through, and allows for the refrigeration system to run at a warmer (and thus more efficient) evaporating temperature.

Figure 5:
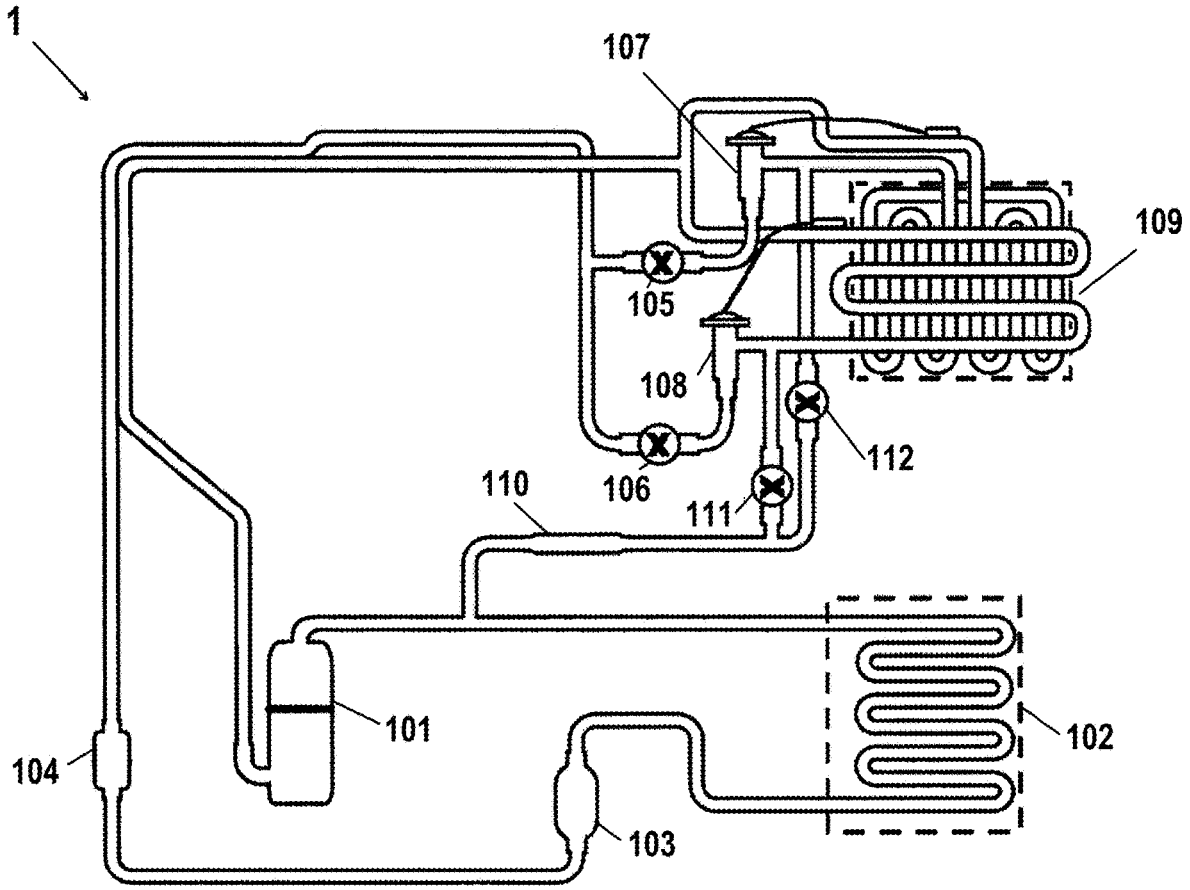
FIG. 5 shows a schematic diagram of an ice-making machine of the present disclosure, including the evaporator of FIGS. 3*a*-3*c*.

FIG. 5 shows a schematic drawing of machine 100 of the present disclosure and illustrates how pan evaporator 10 and pin evaporator 20 can be operated independently. Machine 100 can have compressor 101, condenser 102, optional receiver 103 and/or optional filter drier 104. During a cooling cycle, a refrigerant is compressed in compressor 101, and passed to condenser 102 for cooling. After passing through condenser 102, and optional receiver 103 and/or optional filter drier 104, the refrigerant can be routed to evaporator 1, and one or both of pan evaporator 10 and pin evaporator 20. Refrigerant or liquid line solenoid valves 105 and 106 can be controlled to open or close and control access to expansion valves 107 and 108, respectively. Solenoid valve 105 and expansion valve 107 can control refrigerant flow to pan evaporator 10, and optional solenoid valve 106 in conjunction with expansion valve 108 can control refrigerant flow to pin evaporator 20. Optional filter drier 104 can prevent any particulates in the refrigerant stream from entering expansion valves 107 and 108 and can also include a desiccant.

As noted in FIG. 5, solenoid 106 is optional. Without solenoid 106, refrigerant would continue to run to pin evaporator 20 during freeze cycles, and/or whenever compressor 101 supplies compressed refrigerant.

After exiting the expansion valves 107 and/or 108, the refrigerant is cooled significantly, to the point where it can freeze water in contact with either of evaporators 10 or 20. The refrigerant that leaves evaporator 1 is returned to compressor 101 to restart the compression cycle. During a heating or ice-release cycle, solenoid 105 (and optionally 106) can be closed, and one or both of harvest valves 111 and 112 can be opened so that warm refrigerant passes through pan evaporator 10 and/or pin evaporator 20, respectively. An optional harvest strainer 110 can prevent any particulate matters from passing through harvest valves 111 and 112.

The ability to route refrigerant through pan evaporator 10 and pin evaporator 20 separately and independently of one another provides several advantages in machine 100. It provides significant control over the cooling rate and shape of the cubes formed with in the evaporators. For example, at the beginning of a cooling cycle, refrigerant can pass through each of evaporators 10 and 20. Near the end of the cooling cycle, as the cube is taking its final shape, solenoid valve 105 can be closed, so that refrigerant only runs to pin evaporator 20. This allows for pin evaporator 20 to finish forming the cube by filling in the center of the cube, without any additional cooling from the outer sides of the cube.

One method of making ice that can be performed with machine 100 is described as follows. During a first part of a freeze cycle, liquid line solenoid 105 is open, to allow the refrigerant to flow into pan evaporator 10. During this part of the freeze cycle, refrigerant will also flow to pin evaporator 20, whether optional solenoid 106 is present or not. This provides maximum cooling for machine 100 and will form ice on the walls of cells 30 and on pins 24. During a second part of the freeze cycle, liquid line solenoid 105 is closed, preventing refrigerant from flowing into pan evaporator 10, while refrigerant continues to run to pin evaporator 20. (If used, liquid line solenoid 106 is open at this point.) This will concentrate the cooling on pins 24, to help fill out the center of the cubes. During a harvest cycle one or both of harvest solenoids 111 and 112 are open, allowing warm refrigerant vapor to heat up evaporator 1 and detach ice from evaporator 1.

It does not matter if liquid line solenoid 105 (and optionally 106) is open or closed during the harvest portion of the ice making cycle. Harvest valves 111 and 112 will have a pressure drop across them during the harvest cycle, so the pressure will still be higher on the inlet side of expansion valves 107 and 108 than the outlet sides. If any refrigerant were to flow through valves 107 and 108 it would still flow from inlet to outlet, not backwards. This is why it does not matter if solenoids 105 and 106 are open or closed during the harvest cycle.

Figure 6:
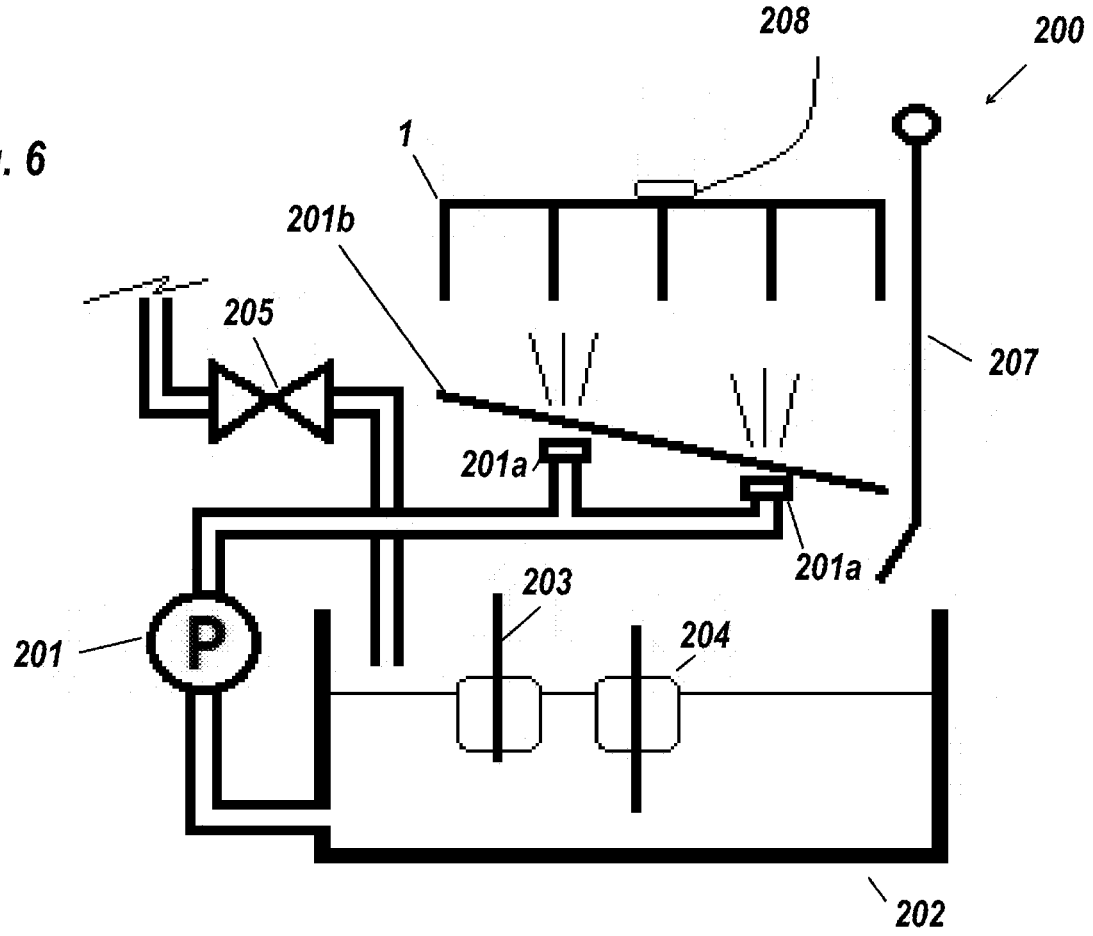
FIG. 6 shows a schematic diagram of water flow that is used in the machine of FIG. 5.

Referring to FIG. 6, a schematic of pump mechanism 200 is shown. Mechanism 200 has pump 201, water jets 201*a*, and sump 202. Pump 201 moves water through jets 201*a*, so that the water is sprayed onto the surface of evaporator 1. Any water that does not adhere and freeze to the surface of evaporator 1 is guided back into sump 202 by a shield 201*b* that partially covers the jets 201*a*. Shield 201*b* can be perforated, so that the water can pass through it and fall back into sump 202.

The perforations in shield 201*b* are such that formed ice particles 40 cannot pass through. Rather, shield 201*b* is at an incline to horizontal, so that the harvested ice particles 40 hit shield 201*b* and slide sideways toward curtain 207 and into a bin (not shown) on the other side of curtain 207. As described in greater detail below, when the ice level in the bin reaches a certain height, curtain 207 will not be able to drop back into its vertical position. This indicates that the bin is full, and ice making should be suspended until the bin is emptied.

Pump mechanism 200 is advantageously designed so that it provides water to evaporator 1 in such a way that water is not exposed to any plastic in machine 100 that is cold enough to freeze the water. When part of the ice slab formed during a freeze process is frozen to a low thermal conductivity material like plastic during a long cycle, it is difficult during a short harvest cycle to push heat into that plastic fast enough to get the ice to release from the plastic. In the present disclosure, water is sprayed onto evaporator 1, and allowed to drain back into sump 202, without letting the water touch any cold plastic. This shortens the time period required to get the ice to release from evaporator 1 and fall away.

High water level float switch 203 and low water level float switch 204 are shown, located in sump 202. Switches 203 and 204 determine when the water level in sump 202 reaches a set high point and a set low point, respectively. A thermistor 208 can measure the temperature of evaporator 1. Thermistor 208 can be attached to pan evaporator 10 directly, for example to plate 12, or to one or more of coils 18. If thermistor 208 is attached to coils 18, it can be at a point either before or after coils 18 contact plate 12.

Figure 7:
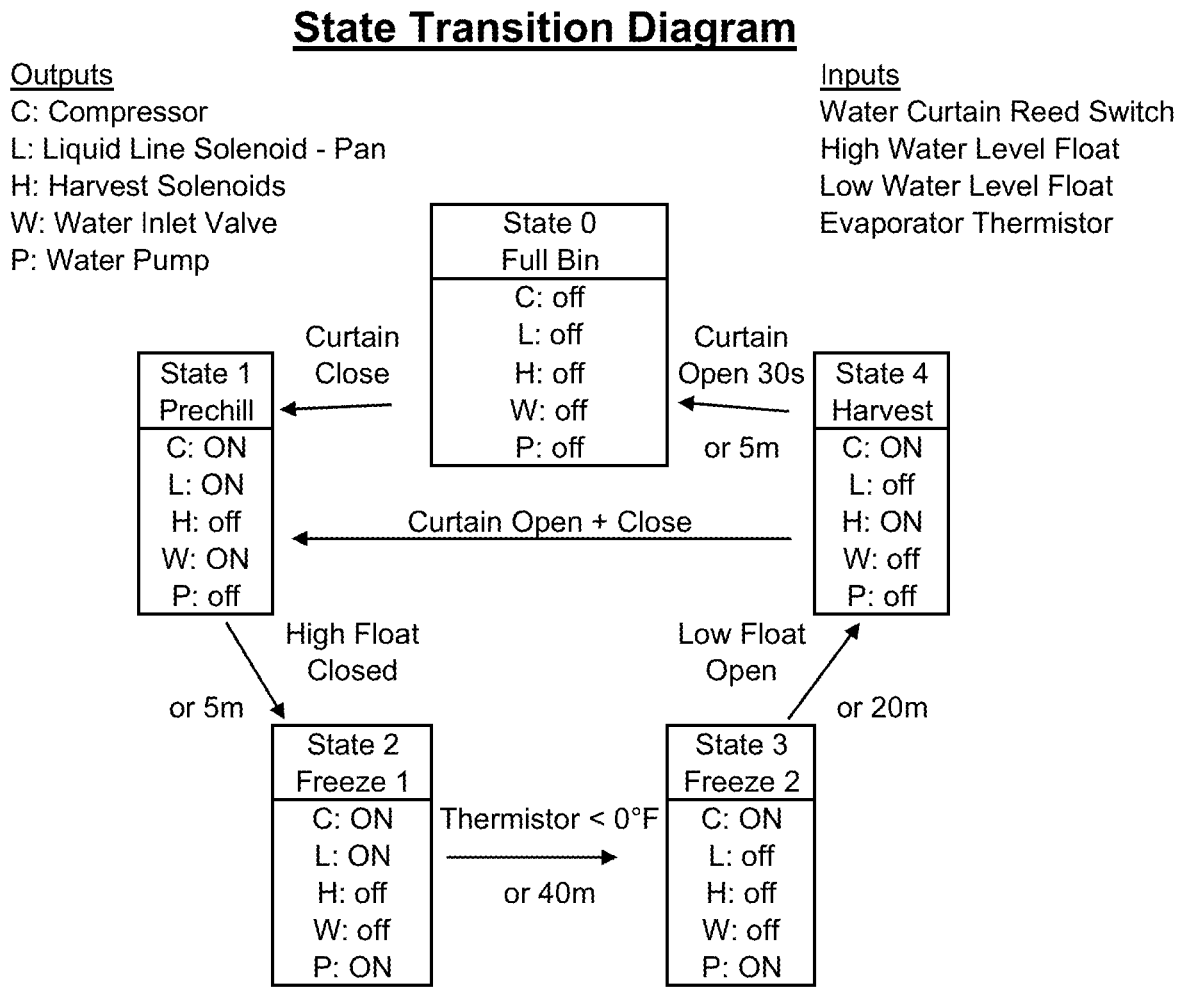
FIG. 7 is a logic diagram illustrating the state of components of the machine of FIG. 5 during various stages of operation.

Referring to FIG. 7, a diagram illustrating the state of various components in machine 100 during the freezing and harvest cycles is shown. In State 0, the shown components—compressor 101, "C", the liquid line solenoid to the pan evaporator 105, "L", harvest solenoids 111 and 112, "H", the water inlet valve 205, "W", and pump 201, "P"—are off, or shut. Water curtain 207 is connected to a switch (not shown), so that machine 100 can detect when curtain 207 is closed. State 0 can correspond to when the bin (not shown) is full of ice, so that a user collects the ice from the bin, which allows curtain 207 to "close", i.e. fall back to its vertical position. When the switch connected to curtain 207 is activated, machine 100 enters state 1, known as "prechill". Compressor 101 is turned on, and solenoid 105 and water inlet valve 205 is opened, so that water flows into sump 202. If used, optional solenoid 106 can be open at this time as well.

After a set period of time (shown as five minutes), or when high water level float switch 203 detects that the water lever in sump 202 has reached a desired height, machine 100 enters state 2, a first freezing stage. At this point, there is enough water in sump 202 to create a desired amount of ice. Pump 201 is activated, so that water is sprayed onto the surface of evaporator 1. The refrigerant was flowing to evaporator 1 in state 1, so that the evaporator is ready to freeze water in stage 2. The refrigerant continues to flow during state 2. Since there is enough water for the time being, water inlet valve 105 is closed.

After either a second period of time (here shown as forty minutes), or when thermistor 208 determines that the surface of evaporator 1 has reached a first set temperature or lower, machine 100 enters state 3, a second freezing stage. In one embodiment, the first set temperature is zero degrees Fahrenheit or lower. At this point, most of the ice has been formed, so solenoid 105 is closed, cutting off refrigerant flow to pan evaporator 10. Pump 201 continues to run. Solenoid 106, if used, is left open. In either embodiment, the flow of refrigerant to pin evaporator 20 continues to flow during this stage.

After a third period of time (shown as twenty minutes), or when low water level float switch 204 detects that the water lever in sump 202 has reached a desired low, machine 100 enters state 4, a harvest state. During state 3, the pump continues to apply water to evaporator 1 for freezing. Since there is no new supply of water through water inlet valve 205, there will eventually not be enough water in sump 202 to apply to evaporator 1. This is determined either by switch 204 or by the passing of the third period of time.

State 4 is a harvest phase, and at this point, pump 201 is shut off, so that no more water is applied to evaporator 1. Rather, compressor 101 continues to operate, passing hot refrigerant through harvest solenoids 111 and 112, which are now open. Warm refrigerant passing through pan evaporator 10 and pin evaporator 20 releases the cubes 40 from cells 30, where they fall into the bin. As previously discussed, it does not matter whether solenoid 105 and optional solenoid 106 are open or closed at this point. After a fourth period of time (here shown as five minutes), machine 100 can return to state 0.

Alternatively, during stage 4 the system may determine that curtain 207 has been open for more than a fifth period of time (here shown as thirty seconds). As previously described, this is an indication that the bin is full of harvested ice, and curtain 207 is not able to close. This condition will also cause the system to return to state 0. If curtain 207 continues to open and close without being open longer than the fifth period of time, this is an indication that the bin is not yet full. In this situation, the system will return to state 1 to start the ice-making cycle again.

While the present disclosure has been described with reference to one or more particular embodiments, it will be understood by those skilled in the art that various changes may be made, and equivalents may be substituted for elements thereof without departing from the scope thereof. In addition, many modifications may be made to adapt a particular situation or material to the teachings of the disclosure without departing from the scope thereof. Therefore, it is intended that the disclosure is not limited to the particular embodiment(s) disclosed as the best mode contemplated for carrying out this disclosure.

What is claimed is:

1. An ice-making machine, comprising:

a compressor;

a refrigerant;

a first evaporator;

a second evaporator connected to the first evaporator so that a protrusion of the second evaporator projects into a cell of the first evaporator;

a first fluid line connected to the compressor at a first end of the first fluid line and further connected to the first evaporator at a second end of the first fluid line, for carrying a first portion of the refrigerant to the first evaporator;

a second fluid line connected to the compressor at a first end of the second fluid line and further connected to the second evaporator at a second end of the second fluid line, for carrying a second portion of the refrigerant to the second evaporator; and a first solenoid valve connected to the first fluid line, for selectively opening and closing the first fluid line to a flow of the refrigerant therethrough.

2. The ice-making machine of claim 1, wherein the first evaporator comprises:

a flat pan with turned up edges, so that a center portion is defined between the edges;

a plurality of partitions in the center portion, so that the cell is defined by the plurality of partitions and/or the edges of the flat pan; and a first serpentine coil connected to the flat pan and the second end of the first fluid line, so that the refrigerant passes through the first serpentine coil.

3. The ice-making machine of claim 1, wherein the second evaporator comprises a manifold connected to the second end of the second fluid line, and the protrusion is connected to and in fluid communication with the manifold, so that the refrigerant flows through the manifold and the protrusion.

4. The ice-making machine of claim 2, wherein the second evaporator comprises a second serpentine coil connected to the second end of the second fluid line, and the protrusion is connected and in fluid communication with the second serpentine coil, so that the refrigerant flows through the second serpentine coil and the protrusion.

5. The ice-making machine of claim 4, wherein the first evaporator has a hole in the flat pan corresponding to a location of the cell, and the protrusion of the second evaporator projects through the hole.

6. The ice-making machine of claim 5, wherein a first diameter of the hole is larger than a second diameter of the protrusion.

7. The ice-making machine of claim 3, wherein the protrusion is pin-shaped.

8. The ice-making machine of claim 1, further comprising a second solenoid valve, connected to the second fluid line, for selectively opening and closing the second fluid line to the flow of refrigerant therethrough.

9. The ice-making machine of claim 1, further comprising a thermistor for measuring a temperature of the first evaporator and/or the second evaporator.

10. The ice-making machine of claim 1, further comprising:

a sump;

a water inlet valve in communication with the sump, for supplying water thereto; and a water pump, wherein the water pump pumps water from the sump to a surface of the first evaporator and a surface of the second evaporator.

11. The ice-making machine of claim 10, further comprising a high water level sensor and a low water sensor in the sump.

12. The ice-making machine of claim 10, further comprising a spray nozzle in fluid communication with the water pump, wherein the water pump pumps water from the sump to the surface of the first evaporator and the surface of the second evaporator via the spray nozzle.

13. The ice-making machine of claim 12, further comprising a perforated shield between the spray nozzle and the first evaporator and the second evaporator, so that unfrozen water falls from the first evaporator and the second evaporator through the perforated shield and into the sump.

14. The ice-making machine of claim 13, further comprising a pivotable curtain, so that frozen ice cubes fall from the first evaporator and the second evaporator, slide off the perforated shield, and contact the pivotable curtain.

15. A method of making ice, comprising the steps of:

providing an ice making machine comprising:

a compressor;

a refrigerant;

a first evaporator;

a second evaporator connected to the first evaporator;

a first fluid line connected to the compressor at one a first end of the first fluid line and further connected to the first evaporator at a second end of the first fluid line, for carrying a first portion of the refrigerant to the first evaporator;

a second fluid line connected to the compressor at one a first end of the second fluid line and further connected to the second evaporator at a second end of the second fluid line, for carrying a second portion of the refrigerant to the second evaporator; and a first solenoid valve connected to the first fluid line, for selectively opening and closing the first fluid line to a flow of refrigerant therethrough;

initiating a first freezing stage of a freeze cycle;

during the first freezing stage of the freeze cycle, controlling the first solenoid valve to be open, and controlling the refrigerant to flow into each of the first evaporator and the second evaporator;

initiating a second freezing stage of the freeze cycle;

during the second freezing stage of the freeze cycle, controlling the first solenoid valve to close, preventing the refrigerant from flowing into the first evaporator, and continuing to control the refrigerant to flow into the second evaporator;

initiating a harvest cycle; and during the harvest cycle, controlling at least one of a pair of harvest solenoids to open, allowing warm refrigerant to flow to at least one of the first evaporator and the second evaporator.

16. The method of making ice of claim 15, wherein the ice making machine further comprises:

a sump, wherein the sump holds water to be sprayed on the first evaporator and the second evaporator; and a high water level sensor in the sump, wherein before the initiating the first portion of the freeze cycle, the method further comprises the steps of:

determining whether a first set period of time has elapsed; and determining whether the high water level sensor has detected that the water in the sump is at a set high value, wherein if the first set period of time has elapsed or the high water level sensor has detected that the water in the sump is at the set high value, the first portion of the freeze cycle is initiated.

17. The method of making ice of claim 15, wherein between the initiating the first freezing stage of the freeze cycle and the initiating the second freezing stage of the freeze cycle, the method further comprises the steps of:

determining whether a second set period of time has elapsed; and determining a temperature of the first evaporator, wherein if the second set period of time has elapsed or the temperature of the first evaporator is less than or equal to a set temperature, the second freezing stage of the freeze cycle is initiated.

18. The method of making ice of claim 17, wherein the set temperature is zero degrees Fahrenheit or lower.

19. The method of making ice of claim 15, wherein the ice making machine further comprises:

a sump, wherein the sump holds water to be sprayed on the first evaporator and the second evaporator; and a low water level sensor in the sump, wherein between the initiating the second freezing stage of the freeze cycle and the initiating the harvest cycle, the method further comprises the steps of:

determining whether a third set period of time has elapsed; and determining whether the low water level sensor has detected that the water in the sump is at a set low value, wherein if the third set period of time has elapsed or the low water level sensor has detected that the water in the sump is at the set low value, the harvest cycle is initiated.

20. The method of making ice of claim 15, wherein the ice-making machine further comprises:

a pivotable curtain; and an ice bin, wherein ice is collected during the harvest cycle and passed into the ice bin by contacting the pivotable curtain, and the pivotable curtain is in a full position when the ice bin is full, wherein after the initiating the harvest cycle, the method further comprises the steps of:

determining whether a fourth set period of time has elapsed; and determining whether the pivotable curtain has been in the full position for a fifth set period of time, wherein if the fourth set period of time has elapsed or the pivotable curtain has been in the full position for the fifth set period of time, the method further comprises the step of ending the harvest cycle.

21. The method of making ice of claim 20, wherein if the fourth set period of time has elapsed and the pivotable curtain has not been in the full position for the fifth set period of time, the method further comprises the steps of:

ending the harvest cycle;

initiating a pre chill cycle; and during the pre chill cycle, controlling the at least one of the pair of harvest solenoids to close, and controlling the refrigerant to flow into each of the first evaporator and the second evaporator.

22. An ice-making machine, comprising:

a refrigerant;

a compressor designed to compress the refrigerant;

a condenser downstream and in fluid communication with the compressor, the condenser designed to cool the refrigerant; and an evaporator downstream and in fluid communication with the condenser, the evaporator designed to form one or more ice particles, wherein the evaporator comprises:

a pan evaporator comprising:

a plate with one or more sides that are bent up to form a center; and a plurality of grid elements placed into the center to form a plurality of cells designed to form the one or more ice particles, wherein the plate comprises a plurality of holes, wherein each hole of the plurality of holes corresponds to a cell of the plurality of cells, and a pin evaporator comprising a plurality of protrusions, wherein each protrusion of the plurality of protrusions is designed to project into one cell of the plurality of cells.

* * * * *